US007373764B1

(12) United States Patent
Sorkin

(10) Patent No.: US 7,373,764 B1
(45) **Date of Patent: *May 20, 2008**

(54) EXTRUDED UPPER BEAM SLAB BOLSTER FOR USE IN CONSTRUCTION

(76) Inventor: Felix L. Sorkin, 13022 Trinity Dr., Stafford, TX (US) 77477

( * ) Notice: Subject to any disclaimer, the term of this patent is extended or adjusted under 35 U.S.C. 154(b) by 420 days.

This patent is subject to a terminal disclaimer.

(21) Appl. No.: 10/688,183

(22) Filed: Oct. 20, 2003

Related U.S. Application Data

(63) Continuation-in-part of application No. 10/223,044, filed on Aug. 19, 2002, now Pat. No. 6,775,954, and a continuation-in-part of application No. 10/223,042, filed on Aug. 19, 2002, now Pat. No. 6,772,571.

(51) Int. Cl.
*E04C 5/16* (2006.01)

(52) U.S. Cl. ..... 52/687; 52/679; 52/677; 52/742.1; 404/134; 404/135; 404/136

(58) Field of Classification Search ..... 52/687, 52/677, 681, 685–689, 742.1, 679; 403/135; 404/136, 135, 134
See application file for complete search history.

(56) References Cited

U.S. PATENT DOCUMENTS

| | | | | |
|---|---|---|---|---|
| 2,229,758 | A * | 1/1941 | Metcalf | 403/391 |
| 3,053,930 | A * | 9/1962 | Mallanik et al. | 403/391 |
| 3,385,557 | A * | 5/1968 | Rambelle | 52/731.3 |
| 4,756,641 | A * | 7/1988 | Hartzheim | 404/136 |
| 5,655,349 | A * | 8/1997 | Ghali et al. | 52/724.2 |
| 5,664,390 | A * | 9/1997 | Sorkin | 52/687 |
| 6,663,316 | B1 * | 12/2003 | Harris | 404/136 |
| 6,735,918 | B2 * | 5/2004 | Haslem et al. | 52/677 |
| 6,772,571 | B1 * | 8/2004 | Sorkin | 52/688 |
| 6,775,954 | B1 * | 8/2004 | Sorkin | 52/686 |
| 6,948,291 | B2 * | 9/2005 | Haslem et al. | 52/677 |
| 2002/0104285 | A1 * | 8/2002 | Schulze et al. | 52/742.1 |
| 2002/0121065 | A1 * | 9/2002 | Schulze | 52/677 |
| 2003/0009978 | A1 * | 1/2003 | Haslem et al. | 52/677 |
| 2003/0009979 | A1 * | 1/2003 | Haslem et al. | 52/677 |
| 2004/0107668 | A1 * | 6/2004 | Haslem et al. | 52/677 |

FOREIGN PATENT DOCUMENTS

| | | | |
|---|---|---|---|
| FR | 2208037 | A * | 7/1974 |
| FR | 2219712 | A * | 10/1974 |
| GB | 2206019 | A * | 1/1989 |
| GB | 2316961 | A * | 3/1998 |
| JP | 10273952 | A * | 10/1998 |

* cited by examiner

*Primary Examiner*—Jeanette Chapman
*Assistant Examiner*—Dan Kenny
(74) *Attorney, Agent, or Firm*—Egbert Law Offices

(57) ABSTRACT

A bolster for use in construction has a beam, a first plurality of leg members on one side of the beam, a second plurality of leg members on an opposite side of the beam, and a plate having a first receptacle on one side and a second receptacle on the opposite side. The first receptacle receives a portion of the first plurality of leg members therein. The second receptacle receives a portion of the second plurality of leg members therein. The plate is integrally formed of an extruded polymeric material.

10 Claims, 2 Drawing Sheets

EXTRUDED UPPER BEAM SLAB BOLSTER FOR USE IN CONSTRUCTION

RELATED U.S. APPLICATIONS

The present application is a continuation-in-part of U.S. application Ser. No. 10/223,044, filed on Aug. 19, 2002, and entitled "Upper Beam Slab Bolster with Parallel Plates", now U.S. Pat. No. 6,775,954, and a continuation-in-part of U.S. application Ser. No. 10/223,042, filed on Aug. 19, 2002, and entitled "Upper Beam Bolster for Use in Construction", now U.S. Pat. No. 6,772,571.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to bolsters that are used in construction activities for the support of post-tension cables, rebars or mesh. More particularly, the present invention relates to upper beam bolsters that are designed for support on underlying layers of mesh and rebar or on slab-on-grade surfaces. Additionally, the present invention relates to plates that can be attached to the existing bolsters so as to convert such bolsters for upper beam use. Additionally, the present invention relates to such plates for use with bolsters in which the plate can be formed by extrusion processes.

BACKGROUND OF THE INVENTION

Bolsters are commonly used in the construction industry for the support of post-tension cables, rebars, or mesh above a surface. Typically, when such materials are used, they must be supported above the surface when the concrete is poured. These bolsters are used with poured decks. In normal use, the bolster is positioned on the deck and includes a beam which extends across a plurality of leg members. This beam is formed so as to contact and support the rebar while the base of the bolster rests on the deck or on a grade. When the concrete is poured, the bolster will support the rebar a proper distance above the bottom surface.

In normal use, such bolsters are preformed so that they can be installed quickly and easily upon the deck. Conventionally, the preformed bolster will have a plurality of leg members and a steel rod welded to a top surface of each of the leg members. The rod will serve as a receiving area for the rebar. Conventionally, these bolsters are formed in preset lengths. If it is necessary to extend the bolster across a long surface of the deck, then the ends of the beams of adjacent bolsters will be wired together such that the bolsters are in an end-to-end relationship.

The most common bolster that is employed is a metal bolster manufactured by Meadow Steel Products of Tampa, Fla. This bolster has a plurality of inverted U-shaped leg members having outwardly extending foot portions. A rigid tubular rod having a slight waveform pattern formed thereon is welded to the middle of the inverted U-shaped leg members. Each of the leg members is generally arranged in parallel relationship to each other. The feet of each of the leg members will rest on the deck while the rebar is supported. After the concrete has solidified, and the deck is removed, the bottom surfaces of the feet will be exposed. As such, it is necessary to coat the feet with an anti-rust material. Alternatively, stainless steel material can be employed for the leg members and their associated feet.

Corrosion and cost are major problems affecting the bolster of Meadow Steel Products. In order to form such a bolster, a great deal of manufacturing must take place, including metal forming, bending, dipping, and welding. These activities, along with the cost of the material used to form the bolster, make the cost of the bolster relatively expensive. If the bolster is not coated or made of a stainless steel material, then corrosion can adversely affect the product. This corrosion can even occur when the metal is coated.

In the past, various attempts have been made to create bolsters of plastic material that can serve the purposes of the bolster of Meadow Steel Products. In general, such efforts have resulted in plastic chairs that are ineffective, cumbersome to use, or unable to properly withstand the forces imparted by the rebar upon the bolster. One such plastic bolster, manufactured by Conac, includes a central beam which is integrally formed with a plurality of leg members. Each of the leg members extends downwardly so as to present a flat surface to the underlying deck. No feet are provided which allow the bolster to be stapled to the deck. Additionally, the configuration of this Conac bolster allows for easy deformation. It is very difficult and time consuming to join lengths of the Conac bolster together. The Conac bolster also lacks the suitable wave form pattern for the receipt of the rebar on the top surface of the bolster. This plastic bolster is often broken, collapsed, or tipped over in actual use. The base of such a bolster has only a very small area of contact with the deck. As such, these plastic bolsters lack the strength and ability to withstand the loads imparted to them.

U.S. Pat. No. 5,664,390, issued on Sep. 9, 1997 to the present inventor, describes a bolster for use in construction. This bolster has a plurality of leg members arranged in parallel relationship and a beam integrally formed with the plurality of leg members and extending across the plurality of leg members. Each of the plurality of leg members has a foot for contacting the underlying surface. Each of the leg members includes a central body portion, a first leg extending downwardly from one side of the central body portion and a second leg extending downwardly from an opposite side of the central body portion. The foot is formed at an end of each of the first and second legs opposite the central body portion. The foot includes a plurality of pin-like projections extending outwardly from a bottom surface thereof. This bolster is of a type for stapling and fixed attachment to an underlying deck. However, under certain circumstances, it would be desirable to be able to use these bolsters for "upper beam" purposes. Upper beam bolsters are often used upon the top of mesh or layers of strands. The upper beam bolsters are commonly used in highway construction where multiple layers of steel are laid out. Under other circumstances, a widened or flat base is required for slab-on-grade construction. The relatively small and narrow feet would sink into sand or dirt if the bolsters of U.S. Pat. No. 5,664,390 were used for "upper beam" purposes. In other circumstances, upper beam slab bolsters are used on corrugating steel decking so as to be in flat surface-to-surface contact with such steel flat surfaces. As such, a need has developed so as to allow the bolster of U.S. Pat. No. 5,664,390 to be properly adapted for upper beam bolster purposes.

The present inventor has filed U.S. application Ser. Nos. 10/223,042 and 10/223,044 on Aug. 19, 2002 for plates for use with such upper beam slab bolsters. In each of these cases, the upper beam bolster that is used in of a type that is formed by injection molding. Whenever injection molding processes are used, the cost of preparing a die is relatively expensive. Ultimately, the cost of the die can determine the profitability or lack of profitability of a particular plate construction. In view of the limited application for such injection-molded plates for upper beam slab bolsters, it was found that the injection molding of such plates reduce the economic advantage associated with attaching a plate to an existing bolster. As such, a need developed in which to reduce the costs associated with the manufacture of such plates for upper beam slab bolsters.

It is an object of the present invention to provide an upper beam slab bolster that is corrosion-proof and relatively inexpensive.

It is another object of the present invention to provide an upper beam bolster which can be made from an easily assembled bolster and support plate.

It is another object of the present invention to provide an upper beam bolster that can withstand the forces imparted to it.

It is a further object of the present invention to provide an upper beam slab bolster that includes a bottom plate that can be formed through extrusion molding processes.

It is still a further object of the present invention to provide an upper beam bolster that is easy to manufacture and easy to use.

These and other objects and advantages of the present invention will become apparent from a reading of the attached specification and appended claims.

BRIEF SUMMARY OF THE INVENTION

The present invention is a bolster for use in construction that has a beam, a first plurality of leg members arranged in generally parallel spaced relationship on one side of the beam, a second plurality of leg members arranged in generally parallel spaced relationship on an opposite side of the beam, and a plate having a first receptacle on one side and a second receptacle on the opposite side. The first receptacle receives a portion of the first plurality of leg members therein. The second receptacle receives a portion of the second plurality of leg members therein. The beam extends transversely across the first and second pluralities of leg members.

In the present invention, each leg member of the first and second pluralities of leg members includes a central body portion and a leg extending downwardly from the central body portion. The leg member of the first plurality of leg members is in planar alignment with the leg member of the second plurality of leg members. Each of the leg members of the first and second pluralities of leg members also includes a foot formed at an end of the leg and extends horizontally outwardly therefrom. The foot has a top surface and a bottom surface. The first receptacle of the plate receives the foot of the first plurality of leg members therein. The second receptacle of the plate receives the foot of the second plurality of leg members therein. The foot includes a plurality of pin members extending downwardly therefrom. These pin members contact a surface of the plate. The top surface of the foot is in abutment with a top of the receptacle. A bottom surface of the foot in contact with a top surface of the plate. The plate is formed of an extruded polymeric material. The portions of the first and second pluralities of leg members are slidably received within the receptacles of the plate.

The beam has a plurality of supports extending downwardly from an underside thereof. The supports are positioned between the first and second pluralities of leg members. The plate has a third receptacle formed thereon between the first and second receptacles. This third receptacle receives the plurality of supports therein. The third receptacle includes a first elongate member extending along a length of the plate and extending upwardly therefrom and a second elongate member extending along a length of the plate and extending upwardly therefrom in generally spaced parallel relationship to the first elongate member. The plurality of supports are interposed between the first and second elongate members.

In the present invention, the first receptacle is defined by a first C-shaped side of the plate. This first C-shaped side extends for a length of the plate. The second receptacle is defined by a second C-shaped side facing the first C-shaped side. The second C-shaped side extends for the length of the plate. Each of the first and second C-shaped sides has an interior diameter slightly greater than a height of the foot of the first and second pluralities of leg members.

The present invention is also an article for attachment to a beam bolster having a generally flat bottom surface, a first receptacle formed on one side of the plate, and a second receptacle formed on an opposite side of the plate. The plate and the first and second receptacles are integrally formed of an extruded polymeric material. Additionally, a first elongate member extends along the length of the plate and upwardly therefrom. A second elongate member extends along the length of the plate and upwardly therefrom in generally spaced parallel relationship to the first elongate member. The first and second elongate members are placed generally centrally on the top surface of the plate between the first receptacle and the second receptacle. The first and second receptacles serve to receive the ends of the feet of a bolster slidably positioned therein. The third receptacle, as defined by the first and second elongate members, serves to receive central supports located directly below the beam of the beam bolster.

DETAILED DESCRIPTION OF THE INVENTION

Figure 1:
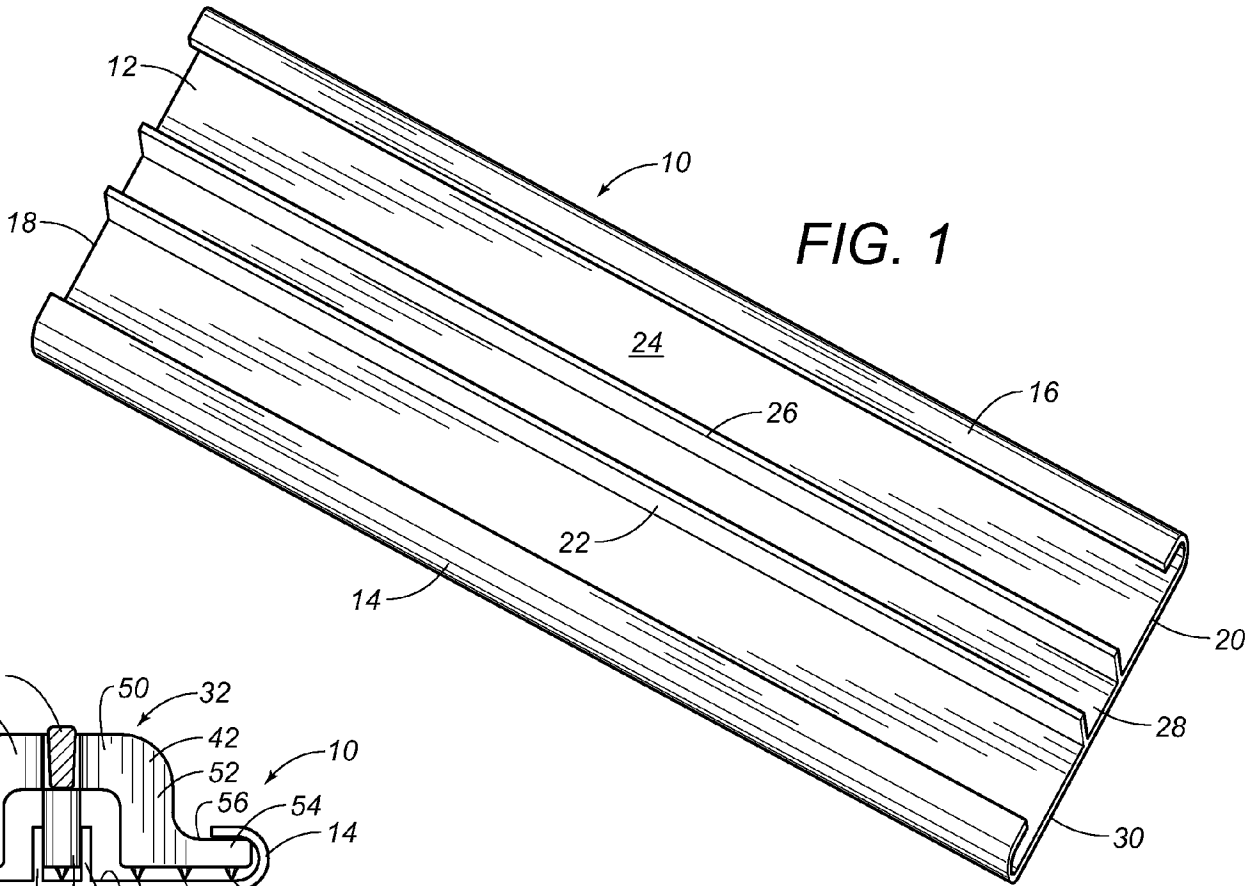
FIG. 1 is perspective view showing the article of the present invention for attachment to a beam bolster.

Referring to FIG. 1, there is shown the article 10 for attachment to a bolster. The article 10 includes a plate 12 having a first receptacle 14 on one side thereof and a second receptacle 16 on an opposite side thereof. As can be seen, the article 10 is integrally formed together, along with receptacles 14 and 16, through an extrusion molding process. In other words, the cross section of the article 10 is substantially identical throughout the entire length of the article 10. Subsequent to extrusion, the article 10 can be cut at the ends 18 and 20 to the length that is desired. The plate 12 includes a first elongate member 22 extending along the length of the plate between ends 18 and 20 thereof and extending upwardly from the top surface 24 of plate 12. A second elongate member 26 also extends along the length of the plate 12 between ends 18 and 20 in generally spaced parallel relationship to the first elongate member 22. A channel 28 is defined along the length of the plate 12 between the elongate members 22 and 26. Channel 28 is suitable for receiving the supports associated with the underside of the beam therein. Receptacles 14 and 16 serve to receive the feet associated with the bolster such that the feet are secured onto the top surface 24 of plate 12.

As can be seen in FIG. 1, the first receptacle 14 is formed on one side of the plate 12. The first receptacle 14 has a generally C-shaped configuration and extends for the length of the plate between ends 18 and 20. The second receptacle 16 also has a generally C-shaped configuration. The receptacle 16 is located on the opposite side of the plate 12 from the receptacle 14. The C-shaped receptacle 16 faces the C-shaped receptacle 14. Each of the receptacles 14 and 16 will extend for the length of the plate.

The plate 12 has a generally flat top surface 24 and a generally flat bottom surface 30. As such, the plate 12 is suitable for being placed upon a flat underlying surface. The top surface 24 can properly receive the underside of the beam bolster thereon while the receptacles 14 and 16 will secure the feet of the bolster therein. Since the article 10 has a generally constant cross-sectional area throughout, it can be easily formed of a polymeric material through a extrusion molding process. The ends 18 and 20 can be cut in a conventional cutting process. As such, the article 10 can be sized to the particular requirements of the construction site.

Figure 2:
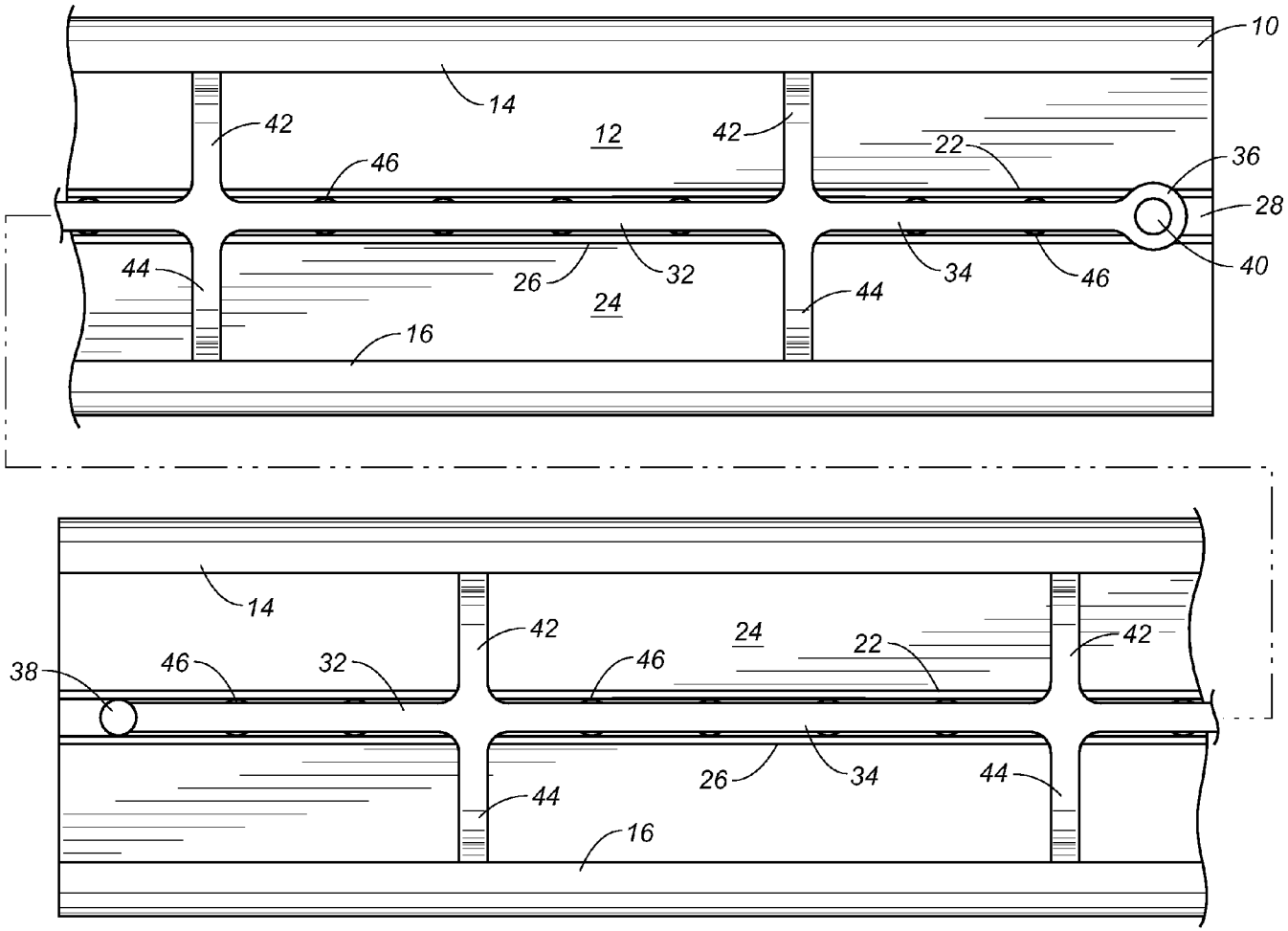
FIG. 2 is a plan view showing the upper beam bolster for use in construction in accordance with the preferred embodiment of the present invention.

FIG. 2 shows a bolster 32 as received within the article 10 of the present invention. The bolster 32 includes a beam 34 extending along its entire length from the receptacle end 36 to the pin end 38. The receptacle end 38 is in the form of an annular member with a receiving hole 40 formed therein. The receiving hole 40 is positioned in such a manner and configured in such a manner so as to properly receive the pin member 38 from the end of an adjacent bolster. The beam 34 has a first plurality of leg members 42 arranged in generally parallel spaced relationship to each other on one side of the beam 34. A second plurality of leg members 44 is arranged in generally spaced parallel relationship to each other and located on an opposite side of the beam 34. The first plurality of leg members 42 and the second plurality of leg members 44 extend transversely relative to the beam 34. Each of the first plurality of leg members 42 is in planar alignment with a corresponding leg member of the second plurality of leg members 44.

As will be describe hereinafter, each of the leg members 42 will have a foot portion which is received within the first receptacle 14. Each of the second plurality of leg members 44 will have a foot portion which is received within the second receptacle 16 of the plate 12. The beam 34 includes support members 46 which extends downwardly from the underside of beam 34. Each of the support members 46 is positioned between the first elongate member 22 and the second elongate member 26 upon the top surface 24 of plate 12. The distance between the first elongate member 22 and the second elongate member 26 is sized so that the support member 46 will be fit snugly therebetween. In all circumstances, it is important to the concept of the present invention that the height of the feet associated with the first plurality of leg members 42 and the second plurality of leg members 44, along with the diameter of each of the support members 46, is suitable for being placed within the first receptacle 14, the second receptacle 16 or by the channel 28 which forms a third receptacle defined in the space between the first elongate member 22 and the second elongate member 26. As a result, unlike the prior art plates that are secured to the underside of the bolster 32, the plate 12 only needs to be extrusion molded. As a result, direct placement of each of the support members 46 within specific openings is not required. It is only necessary to slide the bolster 32 along the length of the plate 12 in order to properly position the bolster 32 upon the plate 12.

Figure 3:
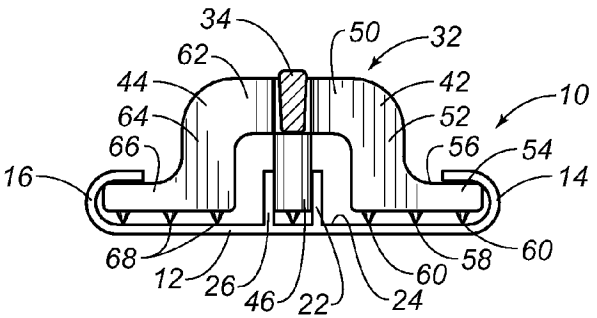
FIG. 3 is an end view showing the placement of a bolster within the plate associated with the present invention.

FIG. 3 is a detailed view showing how the bolster 32 is positioned within the article 10 of the present invention. Importantly, the bolster 32 includes a beam 34 formed centrally thereof. The first plurality of leg members 42 extends outwardly from one side of the beam 34. Each of the first plurality of leg members 42 includes a central body portion 50 and a leg 52 extending downwardly from the central body portion 50. A foot 54 is formed at the end of the leg 52 and extends horizontally outwardly therefrom. This foot 54 has a top surface 56 and a bottom surface 58. It can be seen in FIG. 3 that the first receptacle 14 is of a C-shaped configuration. The diameter of the C-shaped configuration of the first receptacle 14 generally matches the height of the foot 54 between the top surface 56 and the bottom surface 58. A plurality of pin members 60 extend downwardly from the bottom surface of the foot 54 so as to be in contact with the top surface 24 of the plate 12.

The beam 34 has a plurality of support members 46 extending directly downwardly therefrom from an underside thereof. The support members 46 are received between the first elongate member 22 and the second elongate member 26.

The second plurality of leg members 44 extends outwardly from an opposite side of the beam 34. The second plurality of leg members 44 includes a central body portion 62 and a leg 64 extending downwardly from the central body portion 62. A foot 66 is formed at the end of the leg 64 and extends horizontally outwardly therefrom. The foot 60 also includes pin members 68 extending downwardly therefrom. The second receptacle 16 is also of a C-shaped configuration so as to receive the foot 66 therein. The C-shaped configuration of the second receptacle 16 will have a diameter generally matching the height of the foot 66 between bottom of the pin member 68 and the top surface of the foot member 66.

In the configuration shown in FIG. 3, it can be seen that the bolster 32 can be secured within the plate 12 by simply inserting the end of the bolster 32 into an end of the plate 12 and then sliding the bolster 32 along the length of the plate. As such, the flat bottom surface 30 of the plate 12 can reside upon a flat surface.

The foregoing disclosure and description of the invention is illustrative and explanatory thereof. Various changes in the details of the illustrated construction can be made within the scope of the present claims without departing from the true spirit of the invention. The present invention should only be limited by the following claims and their legal equivalents.

I claim:

1. A bolster for use in construction comprising:

a beam;

a first plurality of leg members arranged in generally parallel spaced relationship on one side of said beam;

a second plurality of leg members arranged in generally parallel spaced relationship on an opposite side of said beam, said beam extending transversely across said first and second pluralities of leg members, said beam having a plurality of supports extending downwardly from an underside thereof and between said first and second pluralities of leg members; and a plate having a first receptacle on one side thereof and a second receptacle on an opposite side thereof, said first receptacle receiving a portion of said first plurality of leg members therein, said second receptacle receiving a portion of said second plurality of leg members therein, said plate having a third receptacle formed therein between said first and second receptacles, said third receptacle having said plurality of supports therein.

2. The bolster of claim 1, each leg member of said first and second pluralities of leg members comprising:

a central body portion; and a leg extending downwardly from said central body portion.

3. The bolster of claim 2, the leg member of said first plurality of leg members being in planar alignment with the leg member of said second plurality of leg members.

4. The bolster of claim 2, each leg member of said first and second pluralities of leg members further comprising:

a foot formed at an end of said leg and extending horizontally outwardly therefrom, said foot having a top surface and a bottom surface.

5. The bolster of claim 4, said first receptacle of said plate receiving the foot of said first plurality of leg members therein, said second receptacle of said plate receiving the foot of said second plurality of leg members therein.

6. The bolster of claim 5, said foot having a plurality of pin members extending downwardly therefrom, said plurality of pin members contacting the surface said plate.

7. The bolster of claim 1, said plate being formed of an extruded polymeric material.

8. The bolster of claim 1, said portion of said first and second pluralities of leg members being slidably received respectively within said first and second receptacles of said plate.

9. The bolster of claim 1, said third receptacle comprising:

a first elongate member extending along a length of said plate and extending upwardly therefrom; and a second elongate member extending along the length of said plate and extending upwardly therefrom in generally spaced parallel relationship to said first elongate member, said plurality of supports being interposed between said first and second elongate members.

10. A bolster for use in construction comprising:

a beam;

a first plurality of leg members arranged in generally parallel spaced relationship on one side of said beam;

a second plurality of leg members arranged in generally parallel spaced relationship on an opposite side of said beam, said beam extending transversely across said first and second pluralities of leg members; and a plate having a first receptacle on one side thereof and a second receptacle on an opposite side thereof, said first receptacle receiving a portion of said first plurality of leg members therein, said second receptacle receiving a portion of said second plurality of leg members therein, said first receptacle being defined by a first C-shaped side of said plate, said first C-shaped side extending for a length of said plate, said second receptacle being defined by a second C-shaped side facing said first C-shaped side, said second C-shaped side extending for the length of said plate, each of said first and second C-shaped sides having an interior diameter slightly greater than a height of said portions of said first and second pluralities of leg members.

* * * * *